US011313638B2

(12) United States Patent
Dottle

(10) Patent No.: US 11,313,638 B2
(45) Date of Patent: Apr. 26, 2022

(54) LASER TRAINING DEVICE WITH SIMULATED CYCLING OF A FIREARM ACTION

(71) Applicant: Rustbelt Industries, LLC, San Clemente, CA (US)

(72) Inventor: Samuel Anthony Dottle, Sonora, CA (US)

(73) Assignee: Rustbelt Industries, LLC, San Clemente, CA (US)

( * ) Notice: Subject to any disclaimer, the term of this patent is extended or adjusted under 35 U.S.C. 154(b) by 52 days.

(21) Appl. No.: 16/563,237

(22) Filed: Sep. 6, 2019

(65) Prior Publication Data

US 2020/0088489 A1 Mar. 19, 2020

Related U.S. Application Data

(63) Continuation of application No. 15/364,135, filed on Nov. 29, 2016, now Pat. No. 10,408,556.

(51) Int. Cl.
*F41A 33/02* (2006.01)
*F41A 33/06* (2006.01)

(52) U.S. Cl.
CPC ..... *F41A 33/02* (2013.01); *F41A 33/06* (2013.01)

(58) Field of Classification Search
CPC ..... F41A 33/00; F41A 33/02; F41A 33/04; F41A 33/06; F41G 3/26
See application file for complete search history.

(56) References Cited

U.S. PATENT DOCUMENTS 8,833,876 B2 * 9/2014 Lee ..... A47G 25/06 312/242
2014/0065577 A1 * 3/2014 Quinlan ..... F41A 33/06 434/18

* cited by examiner

*Primary Examiner* — Timothy A Musselman
(74) *Attorney, Agent, or Firm* — Stetina Brunda Garred & Brucker

(57) ABSTRACT

A weapon training device include a frame, a reciprocating member in sliding longitudinal engagement with the frame, and a magazine coupled to the frame. The magazine has a compressed gas chamber in fluid communication with a valve. A light emitter actuated by a switch tied to a trigger is disposed in a barrel. A fire control module has a trigger that is releasably engaged thereto and positioned in axial alignment with the valve, and linked to the switch. A piston is fixed to the frame and is in fluid communication with the magazine valve. A piston sleeve is fixed to the reciprocating member, and the piston is be received therein. An impulse to the piston sleeve from the gas directed into the piston is transferred to a rearward longitudinal motion of the reciprocating member relative to the frame.

11 Claims, 12 Drawing Sheets

LASER TRAINING DEVICE WITH SIMULATED CYCLING OF A FIREARM ACTION

CROSS-REFERENCE TO RELATED APPLICATIONS

The application is a continuation patent application of U.S. patent application Ser. No. 15/364,135 and entitled "Laser Training Device with Simulated Cycling of a Firearm Action" the entire contents of which is wholly incorporated by reference herein.

STATEMENT RE: FEDERALLY SPONSORED RESEARCH/DEVELOPMENT

Not Applicable

BACKGROUND

1. Technical Field

The present disclosure relates to weapons training devices for a user to practice presentation, aiming, firing, and other manipulation skills, and more particularly, to a laser training device that simulates the cycling of a firearm action.

2. Related Art

Firearms are safely and effectively used in a variety of law enforcement, military, self-defense, hunting, competition, and recreational applications every day. Indeed, in the United States, the right to keep and bear arms is so fundamental that it has been enshrined in the Bill of Rights of the Constitution, specifically under the Second Amendment. If a firearm is used criminally or negligently, it is possible for its user to inflict grave harm upon another, yet when used judiciously and with great care, lives can be saved, sustenance may be taken, and a relaxing pastime may be enjoyed.

Firearms safety does not depend on any one factor, but rather, a combination of multiple factors each of equal importance. The quality in the operating mechanism of firearms is now better than ever in the history of firearms, with improved designs, materials, and manufacturing techniques all contributing to safe and reliable functioning. Some incorporate manual safeties that must be disengaged before the firearm may be discharged, while others incorporate grip safeties, and combinations of the two. Most also include internal safeties that prevent the firearm from discharging unless the trigger is pulled, and not when dropped or roughly handled. Additionally, there may be less conventional safeties such as magazine disconnects, loaded chamber indicators, and so on.

Another key factor in firearms safety is training. At the most basic level, competent handling and manipulation is taught to minimize the possibility of negligent discharges. This involves education on the basic safety rules, including treating the firearm as though it were loaded, pointing the muzzle in a safe direction, keeping the finger off the trigger until ready to fire, and knowing the target and what is beyond it. Beyond this, additional training on the fundamentals of marksmanship (sight alignment, trigger pull, follow-through, etc.) further enhances competency.

Once the fundamentals are learned, more specialized training that is particular to the application of the firearm may be undertaken. For instance, members of the infantry may be provided additional training on close quarters battle, or long range sniper operations. Police officers may be trained in use-of-force policies as well as more manual skills such as holster draws, extreme short range point shooting, and so on. Concealed carry permit holders may be instructed on self-defense laws as well as presentations and shooting from deep concealment, while competitive shooters may benefit from training that enhances skills that are critical to success in the respective events. For instance, practical shooting competitions require, in equal measure, speed, accuracy, and agility in shooting from one station to another, while bullseye competitions primarily emphasize accuracy. Shooting is largely regarded as a perishable skill, so it is imperative for anybody who relies upon or uses a firearm to train regularly.

The most effective training regimen for any of the foregoing sub-disciplines of shooting, of course, incorporates a substantial amount of live fire exercises. The combination of the loud noises, recoil, and the immediate feedback of rounds on target is difficult to replicate without real firearms and real ammunition. Yet, regular live fire training may be a challenge for scheduling, logistical, and financial reasons. A firearm may only be safely discharged within the confines of a dedicated range with backstops or berms that adequately confine the fired projectiles. Although indoor ranges are relatively common even in urban areas (excepting major metropolitan regions with restrictive firearms regulations) much gear and equipment must be taken, and the transport of firearms involve additional security considerations and comply with legal requirements. Furthermore, indoor ranges typically assign a relatively narrow single lane to each shooter, and is thus limited to practicing with a single stationary target. Lateral movement is usually prohibited, as are holster draws and rapid firing.

In order to conduct more useful firearms training, it is typically necessary to utilize an entire bay that span twenty feet wide or more, rather than a single lane. This way, targets may be set up at varying distances and varying lateral offsets that requires movement from the shooter. Although some indoor range rent an entire bay, because the entire facility is typically comprised of only one or two bays, scheduling individual training sessions may be challenging, if not impossible. Even more sophisticated shoot houses that simulate various environments such as a residential unit, a commercial building, etc. may be set up. For the most part, such larger facilities with multiple bays available for individual rental are outdoor ranges that are in remote locations. As such, travel to and from such facilities can be time-consuming and may not be practical for regular practice sessions.

Beyond the travel, logistics, and time commitment issues, ammunition is expensive, and so regular live fire training can be cost-prohibitive. Furthermore, availability and pricing can fluctuate wildly depending on the political climate and anticipated events such as elections and newly proposed legislation. Hand-loaded ammunition can be less expensive, but ammunition components are subject to the same market volatility as factory-loaded ammunition with respect to pricing and availability.

As an alternative or as a supplement to live fire training, instructors universally advise dry fire training. An unloaded firearm is cycled to a ready state, and the shooter draws from the holster, presents the weapon, aims, and pulls the trigger. This is done while ensuring that minimal movement is imparted at the moment of the trigger pull, and that there is proper follow-through, that is, keeping the trigger pressed while the firearm remains pointed on target. Some of the exercises may also involve magazine changes, where the existing one in the firearm is released, and a new one is inserted. This process is repeated in an attempt to improve trigger control and overall weapon handling skills, as well as to build muscle memory so that these manipulations can be completed almost instinctually.

Conventional dry fire training may not be as effective as live fire training, however, because of the lack of several key elements associated with discharging a firearm. These include the noise and light flash associated with combustion, recoil, slide reciprocation, and so on. Moreover, there is no way to determine whether the firearm was aimed and fired correctly with accuracy and precision, as there is no confirmation of a target hit, either with holes in the target or with an audio/visual feedback of the projectile hitting the target.

Laser training guns have been developed to address one of these shortcomings of dry fire practice by providing immediate confirmation of hits and misses. A laser is incorporated into a firearm form factor, and is activated when a trigger is pulled. A receiving target illuminates a specific point thereon corresponding to the point of aim of the device at the time the laser was activated or "fired." U.S. Pat. No. 9,429,404 to Moore et al. describes such a laser target device. A single laser unit that is directly activated by the trigger mechanism is disclosed in U.S. Pat. No. 8,458,944 to Houde-Walter, while U.S. Pat. No. 6,572,375 to Schechter et al. discloses an attachment to an existing firearm. Another alternative is a laser disposed in a simulated ammunition cartridge as disclosed in U.S. Pat. No. 9,170,079 to Moore. The laser is activated with a switch that is located where the primer would otherwise be. These devices can be used in conjunction with a real firearm, so the shooter's existing equipment, including all enhancements and accessories therefor, can remain attached for dry fire practice. Furthermore, multiple targets can be set up within a limited space as a garage or a backyard, because there is no danger of fired projectiles, and a training regimen along the same lines as what would otherwise only be possible at an outdoor range can be followed. Traveling to a separate range facility is unnecessary, along with all of the accompanying inconveniences.

While laser-based firearm training has much to offer, it is not a panacea. There are several limitations that detract from the realism of the overall gun handling experience, including the lack of recoil and slide reciprocation/blowback both of which may be referred to as recoil in the general sense. Trigger control tends to be the area of greatest weakness for most shooters, in that there is a naturally tendency to flinch, overcompensate, or otherwise bring the firearm off target just prior to the projectile leaving the barrel or before the trigger pull is completed, in anticipation of recoil. This reflex may be difficult to eliminate even through repeated dry fire exercises, and the most accomplished shooters still work on trigger control fundamentals during training.

Accordingly, there is a need in the art for an improved laser weapon training device that simulates as closely as possible the cycling of a firearm, so that trainees can experience and become accustomed to the entire sensation of firing and manipulating the same. There is also a need in the art for realistic firearm training systems that can be utilized without special range facilities, and preferable from within the comforts of one's home.

BRIEF SUMMARY

The present disclosure contemplates a weapon training device that may, according to various embodiments, include a frame, a reciprocating member in sliding longitudinal engagement with the frame, and a magazine coupled to the frame. The magazine may include a compressed gas chamber in fluid communication with a valve. There may also be a barrel that is defined by a central axis and a muzzle end. The barrel may be fixed to the frame. The device may further include a light emitter that is disposed within the barrel toward the muzzle end. This light emitter may have a light emission axis coaxial with the central axis of the barrel. Additionally, there may be a light emitter switch that is mounted to the frame and in electrical communication with the light emitter.

The weapon training device may further include a piston that is fixed to the frame and defines an internal piston chamber in fluid communication with the valve of the magazine. Gas from the compressed gas chamber of the magazine may be directed into the piston chamber with an actuation of the valve of the magazine. Furthermore, there may be a piston sleeve that is fixed to the reciprocating member, and the piston may be received therein. An impulse to the piston sleeve may be imparted from the gas directed into the piston chamber, and the impulse may then be transferred to a rearward longitudinal motion of the reciprocating member relative to the frame.

The weapon training device may also include a fire control module that is mounted to the frame. The fire control module may include a trigger and a firing pin releasably engaged thereto. The firing pin may be positioned in axial alignment with an actuator of the valve, and may have a longitudinal range of travel. The trigger may also be connected to the light emitter switch.

According to yet another embodiment of the present disclosure, there is a fire control module for a weapon training device. The fire control module may include a fire control module housing defined by a front end and an opposed rear end. There may also be a trigger pivotally mounted within the fire control module housing and having a first positon and a second position. The trigger may include a shoe portion and at least one trigger hook. The fire control module may further include a sear that is movably mounted within the fire control module housing and may define an engagement surface for the at least one trigger hook. Further, there may be a sear block that is pivotally coupled to the sear. A firing pin may be attached to the sear block and slidably mounted to the front end and to the rear end of the fire control module housing. The firing pin may be biased rearward, with rearward motion of the trigger being translated to a forward motion of the sear, the sear block, and the firing pin against the rearward bias until the sear disengages from the sear block, thus driving the firing pin rearward.

Still another embodiment of the present disclosure contemplates a magazine for weapon training device. The magazine may include a magazine body defined by a first compartment and a second compartment. There may be a gas cylinder with a cylinder outlet, and the gas cylinder may be disposed within the first compartment. The magazine may also include a gas valve that is mounted to the magazine body. The gas valve may have an inlet port in fluid communication with the gas cylinder, an outlet port, a valve member, and an actuator connected to the valve member. The magazine may further include a battery that is disposed within the second compartment. There may be one or more terminals in electrical communication with the battery mounted to the magazine body.

The present disclosure will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The detailed description set forth below in connection with the appended drawings is intended as a description of the presently contemplated embodiments of the laser training device, and is not intended to represent the only form in which the disclosed invention may be developed or utilized. The description sets forth the various functions and features in connection with the illustrated embodiments. It is to be understood, however, that the same or equivalent functions may be accomplished by different embodiments that are also intended to be encompassed within the scope of the present disclosure. It is further understood that the use of relational terms such as first and second, top and bottom, proximal and distal, and the like are used solely to distinguish one from another entity without necessarily requiring or implying any actual such relationship or order between such entities.

Figure 1:
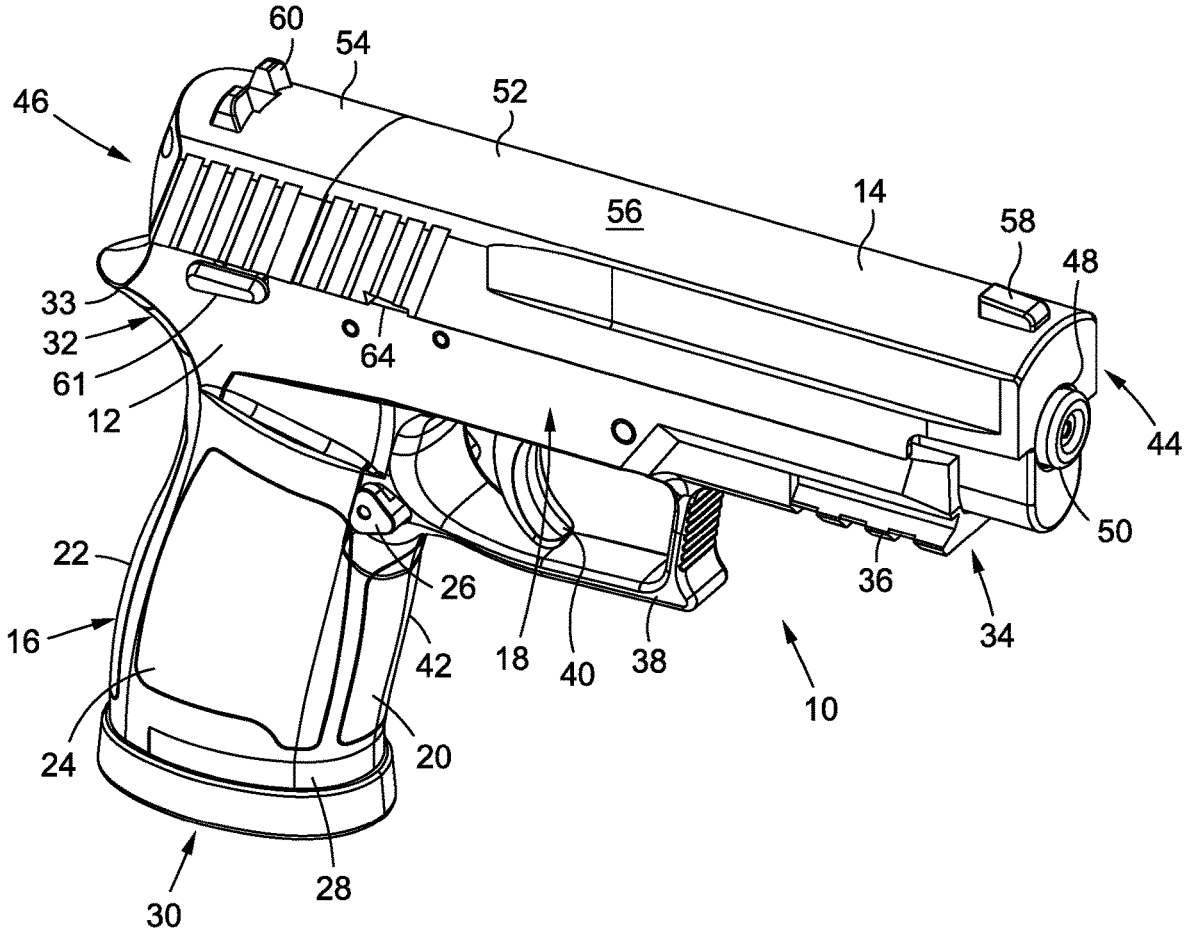
FIG. 1 is a perspective views of a weapon training device in accordance with one embodiment of the present disclosure.

Referring now to FIG. 1, one embodiment of the present disclosure is directed to a weapon training device 10. As illustrated, the weapon training device 10 is configured to mimic or simulate the operation of a semiautomatic pistol, and may be generally defined by a frame 12 and a reciprocating slide 14 that is longitudinally engaged to the frame 12. The frame 12 may be broadly segregated into a grip portion 16 that extends from a body portion 18. The grip portion 16 is defined by a front strap 20 and an opposed rear strap 22, as well as a right side 24 and an opposed left side 26. The front strap 20, the rear strap 22, the right side 24, and the left side 24 may have ergonomic contouring that renders the grip portion 16 more comfortable to hold. The grip portion 16 is understood to be hollow, and accepts a magazine 28 inserted through a bottom end 30 of the grip portion 16, the details of which will be considered more fully below.

The frame 12 is additionally defined by a rear end 32 having a grip beavertail 33 intended to protect the hand of a user from the slide when reciprocating rearward. Opposite the rear end 32 of the frame 12 is a front end 44, which includes a rail 36 that can accept various accessories such as visible and infrared flashlights, laser aiming systems, and so on. The rail 36 may be sized and configured for compatibility with the MIL-STD-1913 standard, which are known in the art as Picatinny rails, though other proprietary accessory mounting rail may be readily substituted. The frame 12 further defines a trigger guard 38 that defines a loop around a trigger 40 that limits the possibility of an unintentional discharge. The size and shape of the trigger guard 38 may be varied in accordance with aesthetic and practical considerations, such as the accommodation of gloved hands. At or around the intersection of the grip portion 16 and the trigger guard 38 is a magazine release 42 that is configured for accessibility from either or both the right side 24 or the left side 24 of the grip portion 16. Depressing the magazine release 42 inwardly toward the interior of the frame 12 is understood to release a catch that retains the magazine 28 in place.

In accordance with various embodiments of the present disclosure, the frame 12 may be fabricated from a polymer or plastic material for reduced weight. Those having ordinary skill in the art will recognize that polymer materials utilized in the fabrication of real firearms and thus have the strength and resiliency to accommodate the more substantial forces encountered in such applications may be utilized in the weapon training device 10. Alternatively, the frame 12 may be fabricated from conventional metallic materials such as steel, aluminum, etc.

The slide 14 is likewise understood to be defined by a front end 44 and an opposed rear end 46. The front end 44 defines a muzzle opening 48 through which a simulated barrel 50 projects. In accordance with one embodiment of the disclosure, the slide 14 may be comprised of a front portion 52 and a rear portion 54 attached thereto. As will be described in further detail below, this configuration is understood to simplify the assembly of certain interior components to the slide 14, and is not intended to be limiting. The slide 14 may have a monolithic or one-piece construction without departing from the scope of the present disclosure. Whether as a unitary structure or a two-piece structure as illustrated, the slide 14 defines a top surface 56. Disposed on the top surface 56 toward the front end 44 of the slide 14 is a front sight post 58. Additionally disposed on the top surface 56 toward the rear end 46 of the slide 14 is a rear notch sight 60.

As indicated above, the slide 14 is understood to reciprocate longitudinally with respect to the frame 12. In most semiautomatic pistols, the slide 14 is understood to remain locked back once all of the ammunition in the magazine is expended. That is, the magazine includes a follower that engages with a slide lock mounted to the frame 12. Similarly, the weapon training device 10 may include such a slide lock 61 that can be pivoted to engage a notch 64 defined on the slide 14 when it is moved in alignment with the slide lock 61.

While the frame 12 may be fabricated from a polymer material, the slide 14 is understood to be fabricated from a metallic material, typically steel. The stresses exerted upon the slide 14 in a real firearm so requires. An environmentally resistant coating may be applied to the surface of the slide 14 after a nitriding, phosphating, or other like process.

The weapon training device 10 is envisioned to mimic as closely as possible a real firearm. Accordingly, it would be preferable to match the weights and weight distribution as between the frame 12, the slide 14, and the magazine 28 filled with ammunition. The embodiment illustrated in FIG. 1 is but one configuration of the numerous possible configurations of a semiautomatic pistol, and those having ordinary skill in the art can readily modify the components of the weapon training device 10 to replicate the aesthetic and ergonomic features of a real firearm of choice. Along these lines, while the embodiment of the weapon training device 10 is a semiautomatic pistol, the various components as will be described in further detail below may be adapted in a replication of any firearm, including semiautomatic rifles, semiautomatic shotguns, and so forth. Thus, the form factor of the weapon training device 10 is presented by way of example only and not of limitation.

Figure 2:
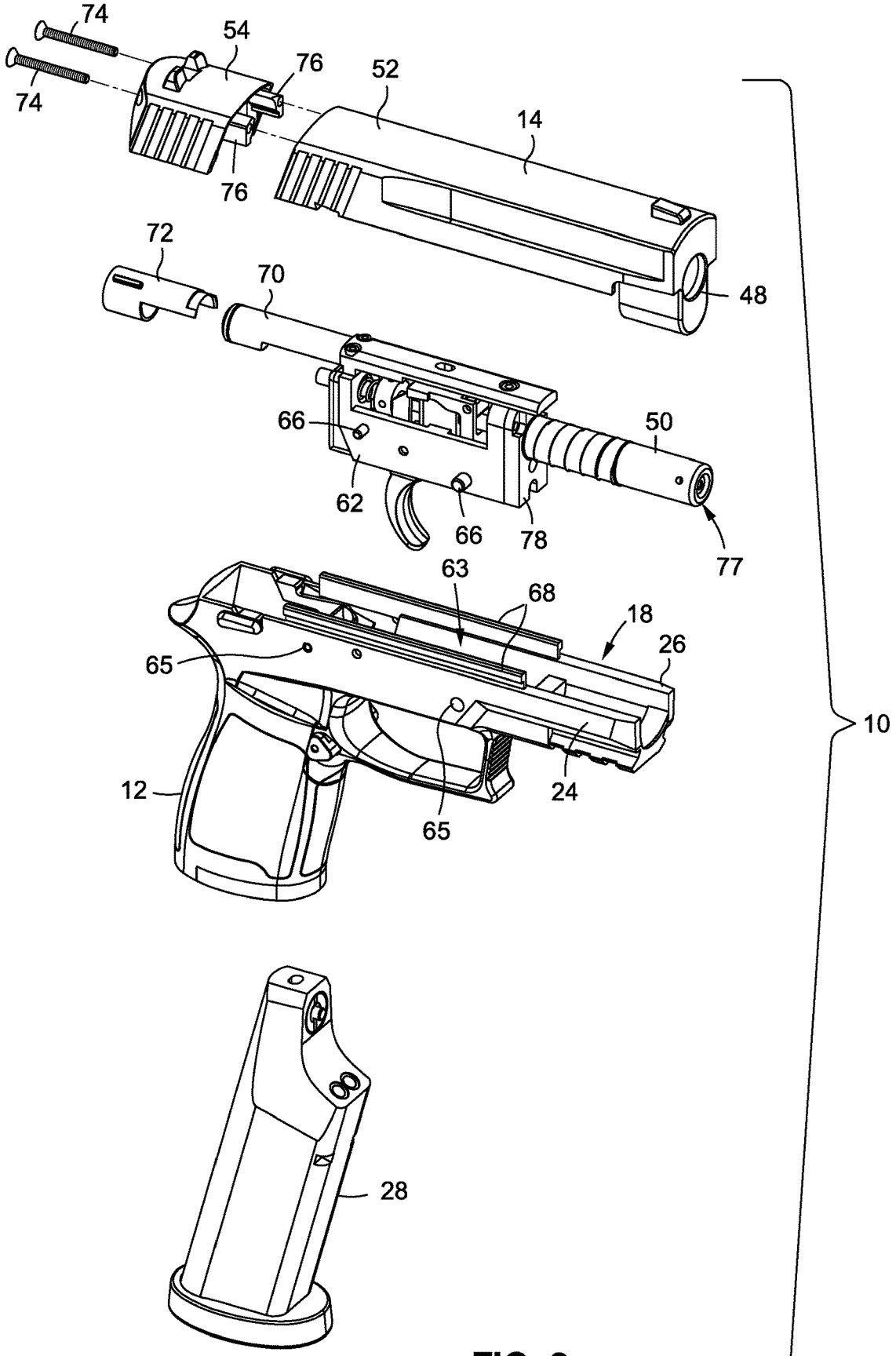
FIG. 2 is an exploded perspective view of the major components of the weapon training device including, a slide, a fire control module, a frame, and a magazine.

In further detail as illustrated in the exploded view of FIG. 2, the weapon training device 10 may be separated into the aforementioned components of the frame 12, the slide 14, and the magazine 28. The weapon training device 10 includes other components that find no correspondence to an actual firearm, as well as those that are, but in modified form.

The frame 12 is understood to house a fire control module 62, which is disposed within a cavity 63 defined by the body portion 18. The frame 12 defines a plurality of retention holes 65 on both the right side 24 and the left side 26 aligned with each other that accepts cross pins 66 retained therein. The cross pins 66 may be inserted through and across the fire control module 62, thereby mounting the same to the frame 12. The length of the cross pins 66 are understood to correspond to the thickness of the frame 12 such that it does not project therefrom and cause snagging. The diameter of the retention holes 65 and the cross pins 66 inserted there through are understood to be configured such that frictional retention of the cross pins 66 is possible. However, any other retention mechanism such as e-clips engageable to grooves formed into the cross pins 66, and so forth may be readily substituted.

In the illustrated embodiment of the weapon training device 10, the slide 14 reciprocates longitudinally along the frame 12. In this regard, the frame 12 defines a pair of opposed slide rails 68 that extend above the top end of the frame 12. The slide 14 is understood to define a pair of corresponding rail slots (not shown) that interface with the slide rails 68. Some embodiments contemplate the entirety of the slide rails 68 being constructed of steel or another type of metal, and co-molded into the polymer frame 12. Alternatively, portions of the slide rails 68 may be formed of the same polymer material as the frame 12 with an internal metallic structure that is exposed at certain locations to directly interface with the metallic slide 14. Any other suitable construction may be substituted, however.

Again, the slide 14 is generally comprised of the front portion 52 and the rear portion 54, which may be separated. As will be described in further detail below, there is a piston 70 that is attached to the fire control module 62, which in turn is mounted to the frame 12 and thus remains static relative thereto. In this regard, the piston 70 may be considered as being fixed to the frame 12, albeit indirectly. There is a piston sleeve 72 that is engageable to the piston 70, and is fixedly attached to the rear portion 54 of the slide 14. The piston sleeve 72 is movable relative to the piston 70, along with the slide 14 to which it is attached. The rear portion 54 is attached to the front portion 52 with a pair of fasteners or screws 74. The rear portion 54 defines a pair of bosses 76 through which the screws 74 are inserted and/or threaded. The front portion 52 also includes corresponding holes to accept the screws 74.

The barrel 50, which is defined by a central axis and a muzzle end 77, is also mounted to the fire control module 62. Additionally, the barrel 50 includes a base flange end 78 that is opposite the muzzle end 77, and serves as a mount to the fire control module 62. When the slide 14 reciprocates rearward, a portion of the barrel 50, and at least the muzzle end 77 thereof, extends or protrudes from the slide 14 through its muzzle opening 48. As the fire control module 62 is mounted to the frame 12, then by virtue of the barrel 50 being mounted to the fire control module 62, the barrel 50 may be considered as being fixed to the frame 12, though indirectly. In various embodiments of the present disclosure, the barrel 50 is understood to be static relative to the frame 12, but not relative to the slide 14. Further, alternative embodiments contemplate directly mounting the barrel 50 the frame 12.

Figure 3:
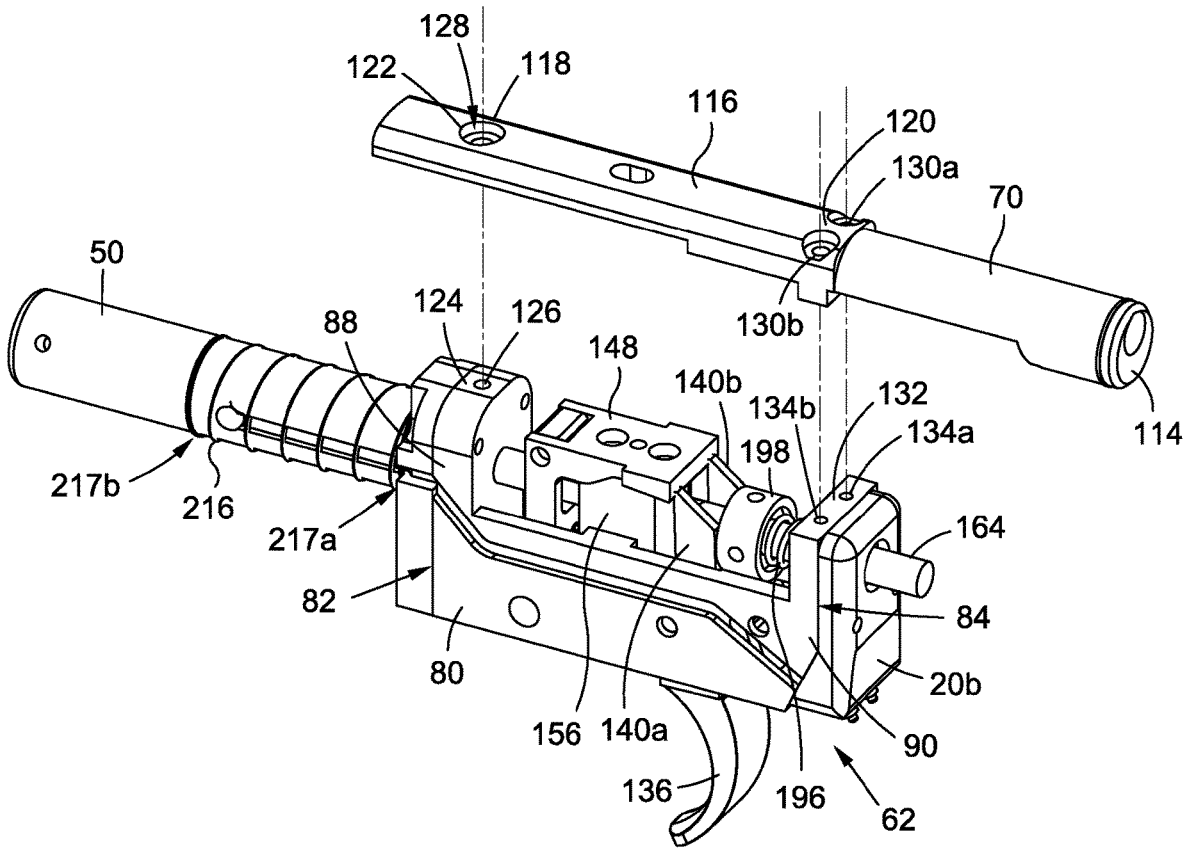
FIG. 3 is a perspective view of the fire control module with a piston mountable thereto.
Figure 4:
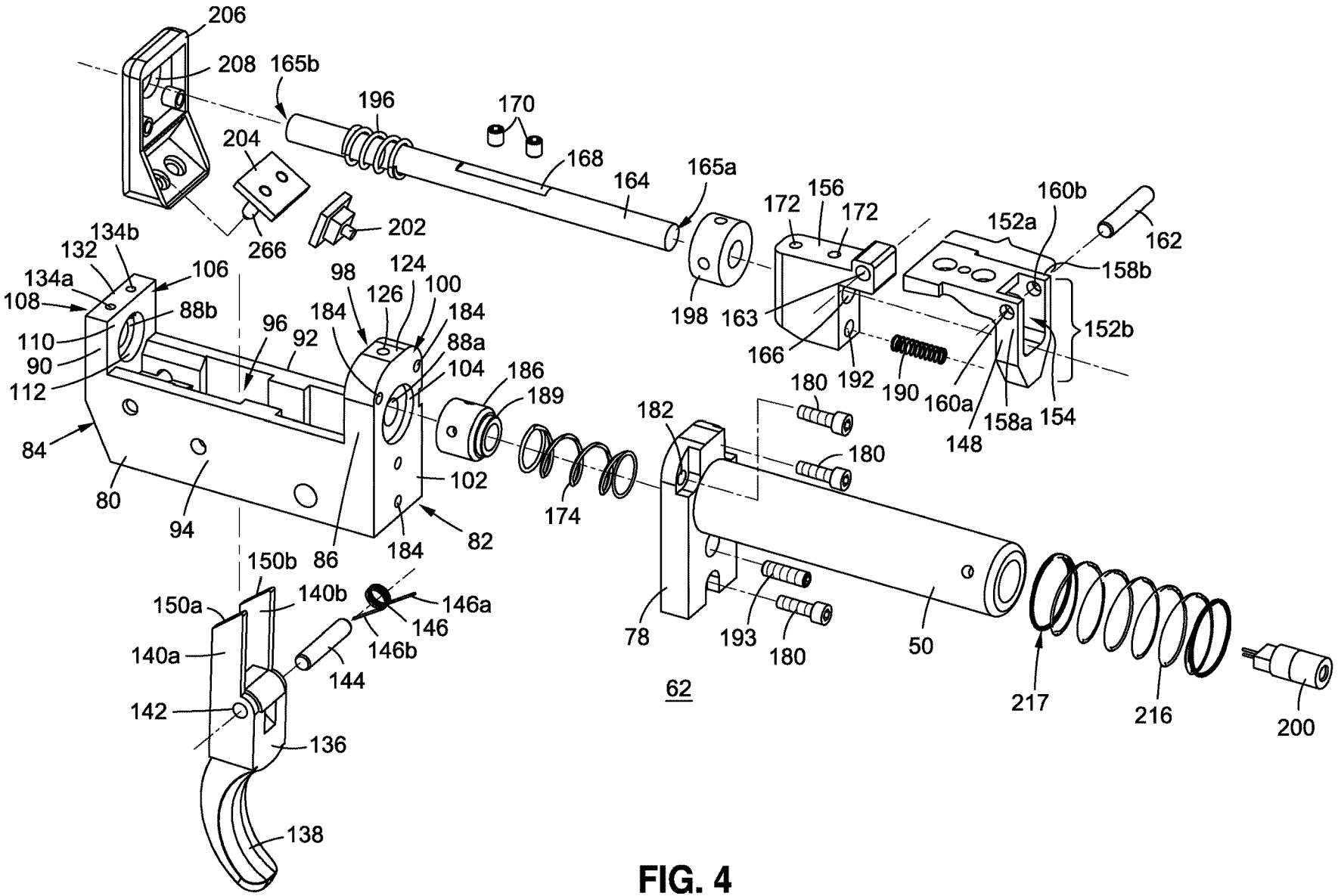
FIG. 4 is an exploded perspective view of the fire control module.
Figure 5:
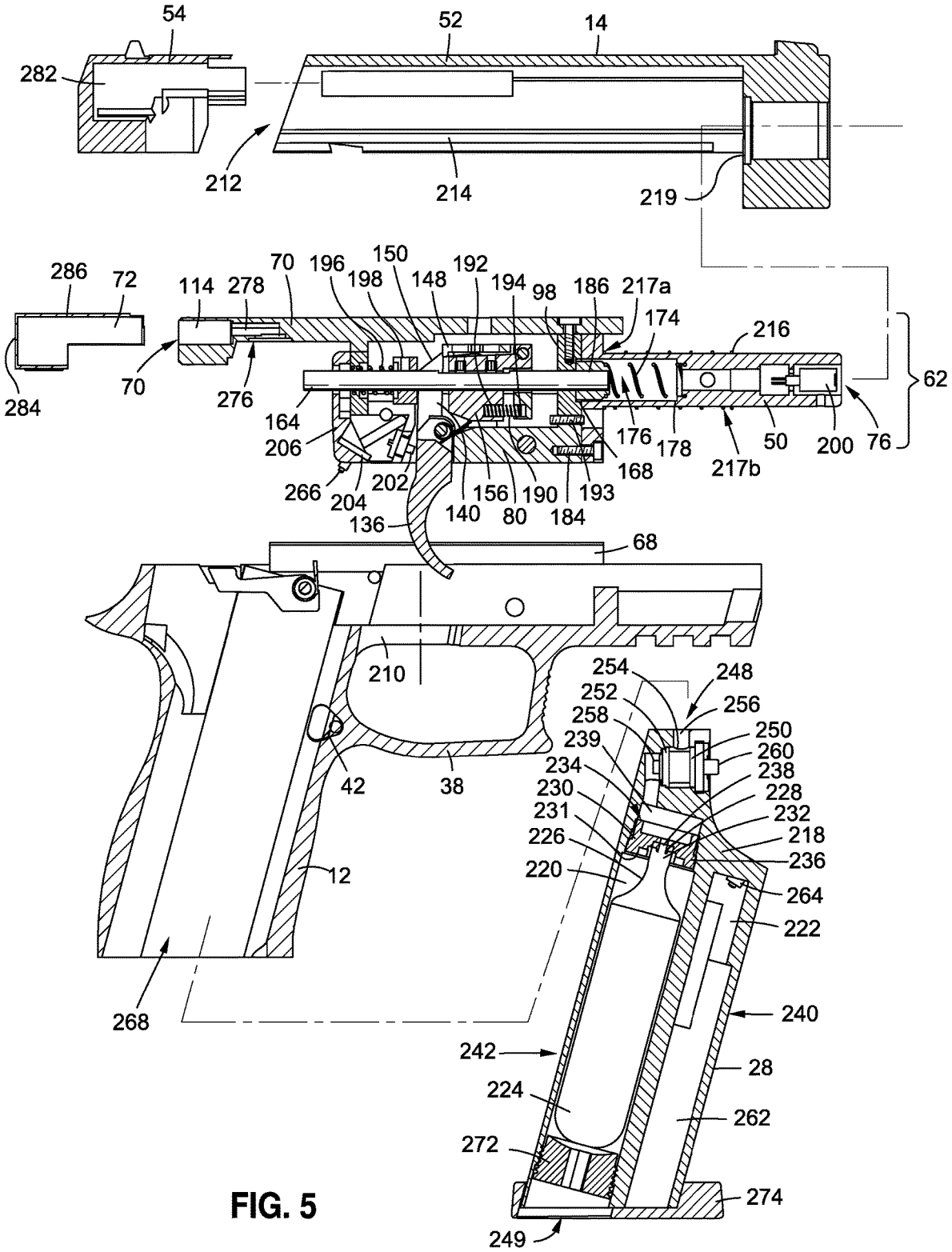
FIG. 5 is an exploded side cross-sectional view of the weapon training device.

With reference to FIGS. 3, 4, and 5, additional details of the fire control module 62 will now be described. Generally, the fire control module 62 is comprised of a housing 80 that receives and retains its various components. The housing 80 is likewise defined by a front end 82 and an opposed rear end 84, which are directionally corresponding to the other front ends and rear ends, respectively, defined relative to the other components of the weapon training device 10. The front end 82 includes a front wall portion 86 defining a first firing pin channel 88*a*, while the rear end 84 includes a rear wall portion 90 defining a second firing pin channel 88*b*. Extending between the front end 82 and the rear end 84 are a pair of sidewalls, including a left sidewall 92 and an opposed right sidewall 94, with a housing cavity 96 being defined in a space bound by the front wall portion 86, the rear wall portion 90, the left sidewall 92, and the right sidewall 94.

The front wall portion 86 is defined by an interior side 98 and an opposed exterior side 100 with a front wall exterior face 102. Defined in the front wall exterior face 102 is a compressor collar capture recess 104 that is coaxial with the aforementioned first firing pin channel 88*a*, the particular function of which will be described in further detail below.

Along the same lines, the rear wall portion 90 is defined by an interior side 106 and an opposed exterior side 108. The interior side 106 has a rear wall interior face 110, in which there is another spring capture recess 112 being defined. The spring capture recess 112 is understood to be coaxial with the second firing pin channel 88*b*.

As particularly illustrated in FIG. 3, the piston 70 is mounted to the housing 80, specifically at the front wall portion 86 and the rear wall portion 90. The piston 70 is generally comprised of a crown portion 114 and a piston mounting arm 116 defined by a front mount point 118 and a rear mount point 120. By way of example only and not of limitation, the front mount point 118 accepts a single fastener, and thus defines a first chamfer 122 coaxial with a first passage 128 through which the fastener is inserted. The front mount point 118 corresponds to the front wall portion 86, which defines a top surface 124 with a threaded hole 126 that is configured to align with the first passage 128 of the piston mounting arm 116 to receive the fastener. The rear mount point 120 accepts a pair of fasteners, and therefore a first passage 130*a* and a second passage 130*b* is defined on the piston mounting arm 116. The rear wall portion 90 likewise defines a top surface 132 with a first threaded hole 134*a* and a second threaded hole 134*b* to which the fasteners are inserted, fixing the piston 70 the housing 80.

Pivotally mounted inside the housing 80 is a trigger 136, which is generally defined by a trigger shoe 138 and a pair of trigger hooks 140*a* and 140*b*. The trigger shoe 138 may have a generally arcuate shape with contoured edge segments for a better ergonomic fit to the index finger of the user. The trigger 136 further defines a journal 142 that accepts a suitably sized and configured trigger pivot pin 144 that secures the trigger 136 to the housing 80. Additionally, there is a trigger return spring 146 that biases the trigger 136 in a forward direction. The trigger return spring 146 includes a first leg 146*a* that abuts against a surface on the trigger 136, and a second leg 146*b* that abuts against a surface on the housing 80. The first leg 146*a* and the second leg 146*b* are maintained in compression between the trigger 136 and the housing 80. Although the illustrated embodiment includes the pair of trigger hooks 140*a* and 140*b*, this is by way of example only and not of limitation. There may be variations in which the trigger 136 includes a single trigger hook 140 as well.

As best illustrated in detail in FIGS. 3 and 5, the trigger 136, and specifically the trigger hooks 140 thereof, are engageable to a sear 148. To this end, the trigger hooks 140*a*, 140*b* each define respective sear engagement surfaces 150*a*, 150*b*. The sear 148 has a generally L-shaped configuration with a first horizontal segment 152*a* and a second vertical segment 152*b* that is orthogonal to the first horizontal segment 152. An interior passage 154 is defined in the sear 148, which provides clearance for a sear block 156 to be mounted thereto. Accordingly, there is a right sidewall 158*a* and an opposed right sidewall 158*b*, each of which define a bearing 160*a*, 160*b*, respectively, for a sear pivot pin 162. The sear block 156 likewise defines a bearing 163 through which the sear pivot pin 162 is inserted. In this regard, the sear 148 is understood to be pivotally mounted to the sear block 156.

The sear block 156, on the other hand, is not configured to rotate relative to the housing 80. Referring again to FIGS. 3, 4, and 5, mounted to the sear block 156 is a firing pin 164. The sear block 156 further defines a firing pin channel 166 through which the firing pin 164 is inserted. The firing pin 164 has an elongate cylindrical configuration defined by a front end 165*a* and an opposed rear end 165*b*, though there is a flat portion 168 that engages with a pair of set screws 170 threaded through corresponding set screw holes 172 defined in the sear block 156. The firing pin 164 is also supported at its front end 165*a* by the first firing pin channel 88*a* defined in the front wall portion 86 of the housing 80. Along these lines, the firing pin 164 is also supported at its rear end 165*b* by the second firing pin channel 88*b* defined in the rear wall portion 90 of the housing 80. The firing pin 164 thus moves longitudinally between these two points, as does the sear block 156, while such longitudinal motion of the sear block 156 being translated from a rotational motion of the sear 148.

The pivoting movement of the trigger 136, which translates into an initial lateral motion of the sear 148, ultimately brings the trigger hook 150 out of engagement with the sear 148, which permits longitudinal movement of the sear block 156 and hence the firing pin 164. Thus, in general, the firing pin 164 is understood to be releasably engaged to the trigger 136 by way of the sear 148 and the sear block 156. Upon being released, the firing pin 164 moves rearward to strike another component of the weapon training device 10 as will be considered in further detail below. The firing pin 164 is thus biased rearward, and this bias is provided by a firing pin spring 174.

The firing pin spring 174 is disposed within a firing pin bore 176. In the illustrated embodiment, the firing pin bore 176 is defined in the barrel 50 and bounded by the front wall exterior face 102 of the housing 80. However, this is by way of example only, and there may be other configurations of the weapon training device 10 which simulates a different firearm or firearm type in which placement of the fire control module 62 in alignment with the simulated barrel may be inappropriate. Again, the barrel 50 includes a base flange end 78 that is positioned against the front wall exterior face 102 of the housing 80, and is secured together with one or more fasteners 180. To this end, the base flange end 78 defines a plurality of retention holes 182 through which the fasteners 180 are inserted and threaded onto the front wall portion 86 of the housing 80, which likewise includes a set of corresponding fastener receiving holes 184. In its assembled state, the barrel 50 and the housing 80 may be deemed to be a part of the overall fire control module 62, even though reference may be made the fire control module 62 separately from the barrel 50.

The firing pin bore 176 has a first notch 178 which engages with a front end of the firing pin spring 174. The opposite rear end of the firing pin spring 174 is engaged to a firing pin spring compressor collar 186, its rear end abutting or otherwise being engageable against a second notch 188 that corresponds to the compressor collar capture recess 104 mentioned above. The firing pin spring compressor collar 186 also includes a notched front end 189 that has a slightly smaller diameter than the firing pin spring 174 for frictionally attachment thereto. The firing pin bore 176 is understood to be cylindrical, as is the firing pin spring compressor collar 186. In this regard, the firing pin spring compressor collar 186 is understood to reciprocate within the firing pin bore 176, and maintains the firing pin spring 174 in compression. The firing pin spring compressor collar 186 is also fixed to the firing pin 164, and thus it is understood that the firing pin spring 174 provides the aforementioned rearward bias of the firing pin 164.

With the firing pin 164 being biased rearward due to the rearward spring force upon the firing pin spring compressor collar 186 exerted by the firing pin spring 174, the combined pivoting assembly of the sear 148 and the sear block 156 may likewise have a rearward bias. The angular relationship and/or the distance between the sear 148 and the sear block 156 is understood to remain constant in response to a forward motion of the trigger hook 150 at least in part because of a sear return spring 190 disposed between the sear 148 and the sear block 156. More particularly, the sear block 156 defines a spring bore 192, and the sear 148 likewise defines a counterpart spring bore 194 that is axially aligned with the spring bore 192 with the sear 148 and the sear block 156 aligned with each other.

Inserted into the front wall portion 86 of the housing 80 and projecting from the interior side 98 of the same is a sear trip set screw 193. The forward motion of the sear block 156 and the sear 148 is arrested by the sear trip set screw 193 and causes the sear return spring 190 to compress against its natural bias. The trigger hooks 140 thereafter disengage from the sear 148 as it pivots clockwise (relative to the view shown in FIG. 5 of the right side of the weapon training device 10) or rearward. The sear return spring 190 is also operative to reposition the sear 148 to be in alignment with the sear block 156 once the trigger 136 is released.

The firing pin 164 is contemplated to travel rearward with sufficient force to trip an actuator of a gas valve. To this end, there is understood to be a short overtravel to ensure reliable actuation. However, upon completing this instantaneous actuation, the firing pin 164 no longer exerts any rearward force, even if the face of the rear end 165*b* rests against the actuator. As such, there is a counter spring 196 inserted onto the firing pin 164 that applies a forward bias thereon. There is a ring-shaped counter spring compressor 198 also attached to a specific positon on the firing pin 164, and maintains the counter spring 196 in compression against the rear wall portion 90 of the housing 80. As noted above, the rear wall portion 90 defines the spring capture recess 112, and the counter spring 196 is retained therein.

The release of the firing pin 164 is not the only function that is contemplated in response to pulling the trigger 136. Various embodiments of the weapon training device 10 are understood to incorporate a light emitter 200 that is disposed within the barrel 50 toward its muzzle end 77. The light emitter 200 is understood to have a light emission axis that is coaxial with the central axis of the barrel 50, e.g., the emission axis simulates a projectile being fired from the barrel. The light emitter 200 is preferably an infrared laser, though any other suitable source may be readily substituted without departing from scope of the present disclosure. In order to save power and reduce the possibility of overheating, the laser may be pulsed with a minimal duty cycle that is still sufficient to activate a receiving element on a light-sensitive target at which the emission is directed.

The light emitter 200 is actuated in response to an actuation of a light emitter switch 202, an actuator of which is disposed in the rotation path of the trigger 136, such that when the trigger is pulled and the firing pin 164 is disengages, the light emitter switch 202 is also actuated. The light emitter switch 202 may be connected to a power source as well as various control and interface circuitry mounted to a printed circuit board 204. This includes circuitry to implement the aforementioned pulsed emission. The light emitter switch 202 and the printed circuit board 204 may be mounted to the housing 80 and are part the fire control module 62. In accordance with various embodiments, the fire control module 62 may include a block cap 206 that is mounted to the rear end 84 of the housing 80. The block cap 206 is understood to define an aperture 208 through which the firing pin 164 extends.

As noted earlier, the fire control module 62 is installed on to the frame 12. To accommodate the protruding trigger 136, the frame 12, above the trigger guard 38, defines an opening 210 through which the trigger 136, and specifically, the trigger shoe 138 extends. Also mounted to the frame 12 is the slide 14. Preferably, though optionally, the front portion 52 engaged to the slide rails 68 from the rear end 212 thereof. The slide 14 defines a pair of opposed rail slots 214, with an open rear end. The barrel 50 passes through the muzzle opening 48 of the slide 14.

As is the case with a real firearm, the slide 14 of the weapon training device 10 is understood to be biased in a forward direction toward the muzzle end. There is an action spring 216 that is inserted onto the barrel. A rear end 217*a* of the action spring 216 abuts against the base flange end 78, while an opposed front end 217*b* of the same abuts against an action spring retention notch 219 defined on the muzzle end of the slide 14 with it installed onto the frame 12. Thus, the action spring 216 is maintained in compression between the base flange end 78 and the interior muzzle end section of the slide 14. As will be described in further detail below, when the firing pin 164 strikes an actuator of a compress gas source, the entirety of the slide 14 is pushed rearward. Once the slide 14 reaches its maximum travel point along the frame 12, the action spring 216 is understood to return the same to its origin or resting/forward position.

Figure 6:
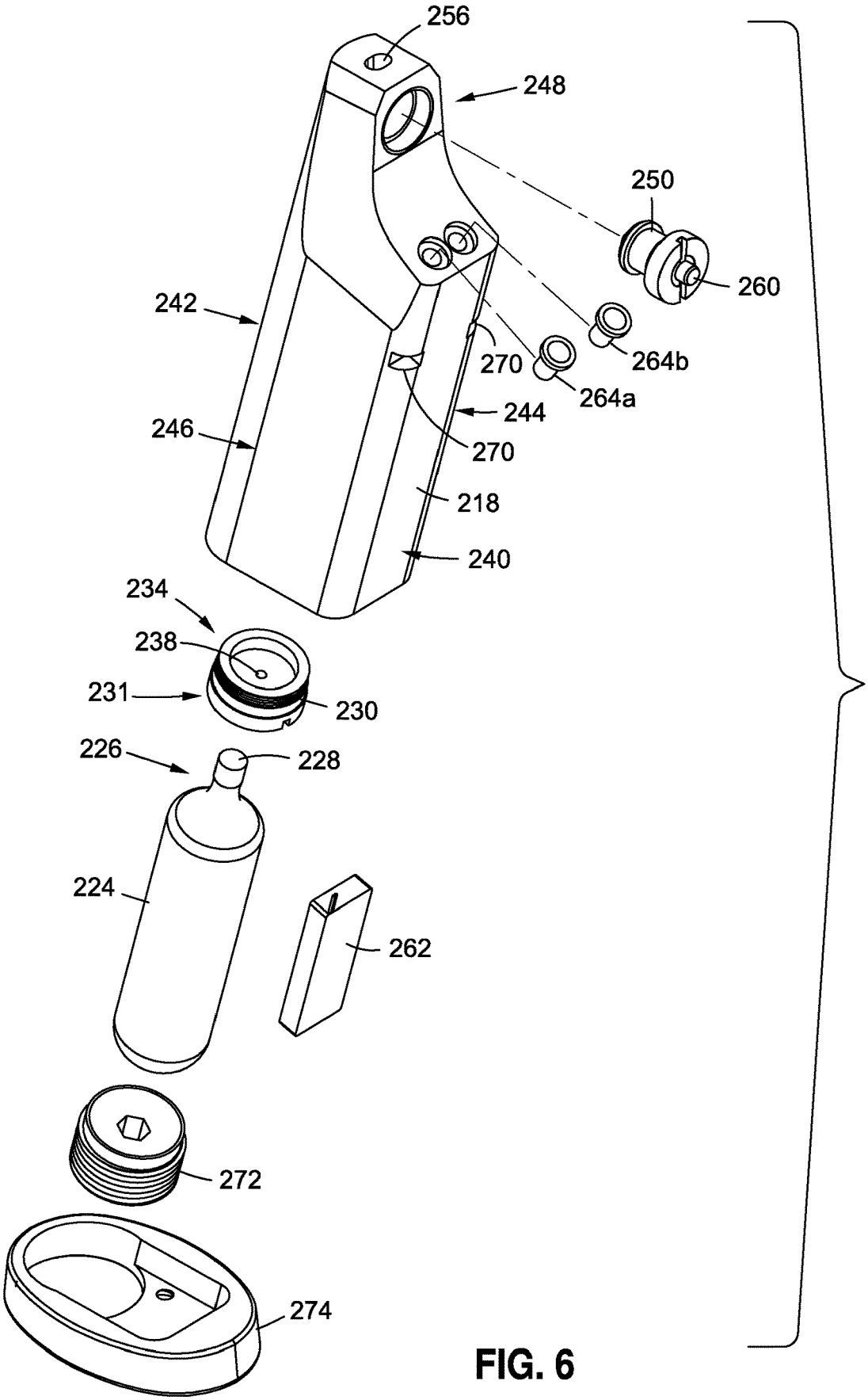
FIG. 6 is a detailed side cross-sectional view of a magazine in accordance with another embodiment of the present disclosure

Then electrical power source powering the light emitter 200 and the pneumatic power source that aids with the reciprocation of the slide 14 are stored in the magazine 28 in accordance with various embodiments of the present disclosure. Referring to the cross-sectional view of FIG. 5 and the perspective view of FIG. 6, the magazine 28 is generally defined by a magazine body 218. Further, the magazine body 218 defines a first compartment 220 as well as a second compartment 222.

Disposed within the first compartment 220 is a gas cylinder 224 that holds a compressed gas. In one embodiment, the compressed gas is carbon dioxide, though any other suitable gas may be substituted. Moreover, the gas cylinder 224 may be a conventional and standardized carbon dioxide canister that is sold for carbonating liquids or to propel pellets in air guns, paintball guns, and so forth. The gas cylinder 24 may thus have a conventional tapered nozzle 226 or outlet with a membrane seal 228 that may be broken by inserting the same into a cylinder adapter 230. Specifically, the cylinder adapter 230 is defined by a cylinder side 231 with a piercing connector 232, and an opposed chamber side 234. A portion of the adapter body is threaded, so that the cylinder adapter 230 may be threaded onto a corresponding receiving portion 236 defined by the magazine body 218. The piercing connector 232 defines a fluid passageway 238 to a compressed gas chamber 239.

The magazine body 218 has a generally elongate cuboid shape with a front 240, and opposed rear 242, a left side 244, and an opposed right side 246. Additionally, the magazine body 218 has a top end 248. The compressed gas chamber 239 is in fluid communication with a gas valve 250 that is mounted to the magazine body 218. The gas valve 250 includes an inlet port 252, an outlet port 254 that is contiguous with a cylinder opening 256 defined on magazine body 218 at the top end 248 thereof. The gas valve 250 further includes a valve member 258 that selectively fluidly connects the inlet port 252 to the outlet port 254. The valve member 258 is actuated with an externally accessible actuator 260, which protrudes from the front 240 of the magazine body 218. The actuator 260 is understood to be spring-loaded, such that an impact from, for example, the firing pin 164 momentarily actuates the valve member 258, then passes the compressed gas from the gas cylinder 224 as partially stored in the upstream path therefrom including the compressed gas chamber 239, to the outlet port 254. The duration of actuation may be adjusted based on the spring weight of the spring in the gas valve 250 and the spring weight of the firing pin spring 174, as possibly dampened by the counter spring 196.

Disposed within the second compartment 222 is a battery 262. According to various embodiments, the battery 262 is a rechargeable lithium type, though any other suitable type may be substituted. Furthermore, the battery 262 is illustrated is having a cubic shape, though more standard battery form factors such as AA/AAA/CR-123, etc. may be substituted, though such substitutions will be accompanied by battery holders that are suitably sized and disposed within the magazine 28.

The positive and negative terminals from the battery 262 are electrically connected to respective terminal contacts 264*a*, 264*b*, which are embedded in the magazine body 218 and accessible from the front 240 of the same. Electrical power may be delivered to an external destination through the terminal contacts 264, as well be received from a charging device. The terminal contacts 264 are understood to make a mechanical and electrical connection with a corresponding pair of terminal contacts 266 that are mounted to the printed circuit board 204. The terminal contacts 266 are sized, positioned, and oriented to so connect to the terminal contacts 264 of the magazine 28 when it is coupled with the frame 12.

The terminal contacts 266 are understood to be spring-loaded and be retracted or extended. Thus here is some flexibility with how close the terminal contacts 264 of the magazine 28 must be positioned relative to the terminal contacts 266 on the fire control module 62 to complete the electrical circuit. The electrical connection from the printed circuit board 204 to the light emitter 200 as completed by the actuation of the light emitter switch 202, may be completed with a wire that is routed through the various components of the weapon training device 10 as disclosed earlier. Alternatively, multiple metallic traces may be laid out on the components, with the connections between moving and/or separate components utilizing similar extending/retracting contacts.

As shown in FIG. 5, the frame 12, in the grip portion 16 thereof, defines a magazine cavity 268, into which the magazine 28 is inserted. The aforementioned magazine release 42 captures the magazine 28 with one or more grooves 270 that are defined on the magazine body 218, specifically at the corners between the front 240 and the right side 246, and the font 240 and the left side 246. The size and shape of the grooves 270 correspond to that of the magazine release 42.

The magazine body 218 also defines a bottom 248 that is open to the first compartment 220 to receive the aforementioned gas cylinder 224. In some embodiments, the second compartment 222 is likewise open such that the battery 262 is also removable. However, if a rechargeable battery that is not in a standard form factor is used, then the battery 262 may be permanently fixed to the magazine 28. Accordingly, the bottom 248 may not define an opening to the second compartment 222.

Since the gas cylinder 224 is typically not rechargeable directly from inside the magazine body 218, it is contemplated to be removable. The bottom end 249 of the magazine body 218, specifically in the first compartment 220, is understood to be threaded to accept a cap 272. The gas cylinder 224 is retained within the first compartment 220 with the cap 272. The bottom end 249 of the magazine body 218 may also include a base plate 274 constructed of a flexible material such as rubber to absorb any shocks imparted to the magazine 28 when dropped from the frame 12. Additionally, the base plate 274 may include aesthetic design elements that provide a continuous visual appearance with the frame 12. The base plate 274 may be removably attached to the magazine body 218, though this is exemplary only. There may be embodiments in which the gas cylinder 224 is permanently installed inside the magazine body 218, with a second valve disposed in another accessible location that accepts a pneumatic connection to an external compressed gas source.

With the magazine 28 inserted into the frame, the outlet port 254 is understood to be positioned directly over a piston chamber opening 276 that is defined in the piston 70. There is a passageway 278 leading to a piston chamber 280 that is also defined within the crown portion 114 of the piston 70. The piston sleeve 72 is fitted over the piston 70, and also mounted to the rear portion 54 of the slide 14, as discussed above. In this regard, the slide 14 further includes a sleeve mounting slot 282. The piston sleeve 72 is defined by a rear vertical wall 284 having a circular profile that matches the circular profile of the crown portion 114, which is understood to have a cylindrical shape. The piston sleeve 72 is also defined by a cylindrical sidewall portion 286, and is in sliding relationship with the piston 70.

Having considered the various components and subcomponents of the weapon training device 10, a basic operational cycle over one trigger pull will now be described. The sequence of FIGS. 7A-7D show the operation of the fire control module 62, with FIG. 7A specifically illustrating the weapon training device 10 in a ready/resting state with the trigger 136 being in an undisturbed, first position. The trigger hook 140 rests against the sear 148, and held in this position with the sear block 156. Additionally, the trigger return spring 146 biases the trigger 136 forward and the trigger hooks 140 rearward. A rearward bias is being applied to the firing pin 164 by the firing pin spring 174 pressing against the firing pin spring compressor collar 186, while a slight forward bias is applied to the firing pin 164 by the counter spring 196 pressing against the counter spring compressor 198. Additionally, the slide 14 is biased forward by the action spring 216. The rear end **165*b* of the firing pin 164 abuts against, or is at least in close proximity to the actuator 260 of the gas valve 250, and the compressed gas chamber 239, which is under pressure from the compressed gas in the gas cylinder 224, is not in fluid communication with the outlet port of the magazine 28, or the piston chamber 280 of the piston 70**.

Figure 7A:
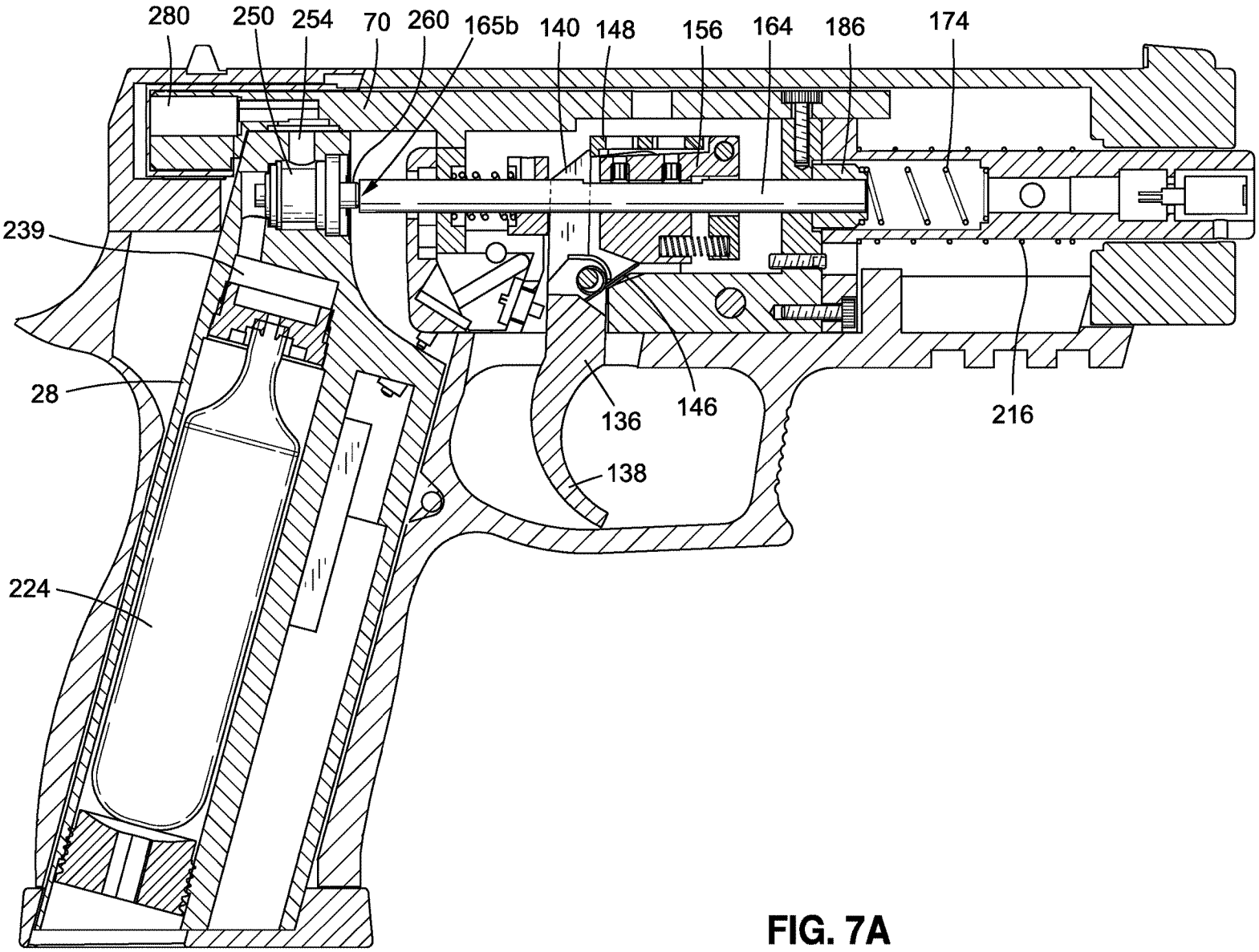
FIGS. 7A-7D are side cross-sectional views of the weapon training device showing the various phases in the cycle of operation of the fire control module.
Figure 7B:
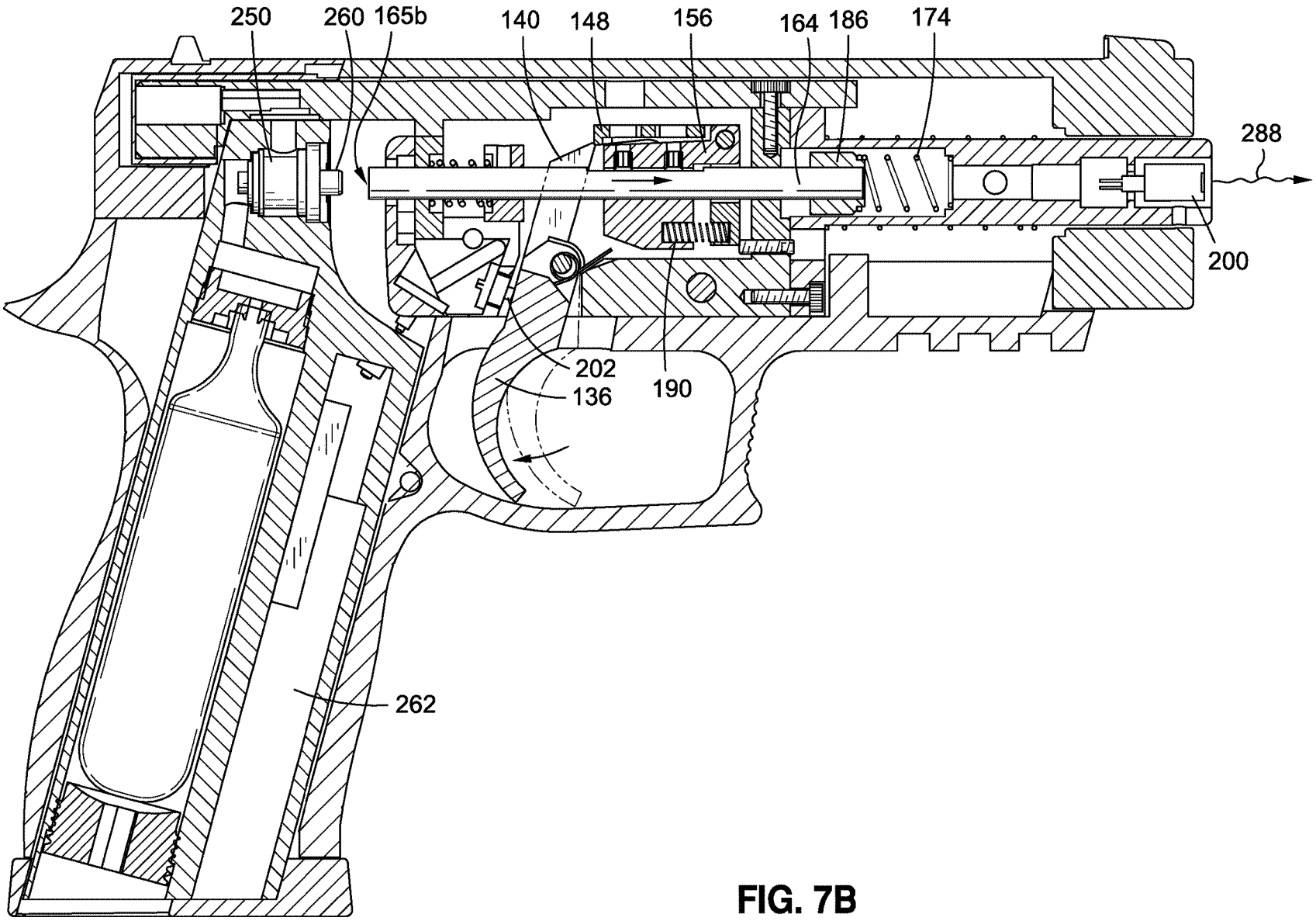

Next, as shown in FIG. 7B, a user begins to pull the trigger 136 rearward. As the trigger 136 pivots about a center on the housing 80, the trigger hooks 140 moves forward, overcoming the rearward bias upon the sear 148 as applied through the sear block 156 and the firing pin 164. The relative orientation of the sear 148 to the sear block 156 is maintained by the sear return spring 190. The firing pin spring compressor collar 186 moves forward in opposition to the firing pin spring 174, which also results in the firing pin 164 moving forward. The rear end **165*b* of the firing pin 164 moves away from the actuator 260 of the gas valve 250. The trigger 136** as shown may be considered to be in a second position.

Additionally, the light emitter switch 202 is actuated by way of the trigger 136 impacting the same. The electrical circuit from the battery 262 to the light emitter 200 is completed, thereby activating a light emission 288. According to some embodiments, the light control circuitry may trigger an instantaneous pulse of sufficient power and duration to activate a sensor element on a target. This triggering may take place when the trigger 136 reaches the end of its set rotational travel about the trigger pivot pin 144, and mechanically trips the light emitter switch 202. This is understood to be substantially contemporaneous with the disengagement of the sear 148 from the sear block 156. It is also possible to delay the generating of the pulse for a predetermined time period to better simulate the delay between a striker hitting a primer, to igniting the power, to the bullet leaving the barrel, and the resulting recoil (in a recoil operated firearm action) that results in the slide reciprocating or "blowing back."

Although it is also possible to generate a continuous pulse while the light emitter switch 202 remains actuated, e.g., while the trigger 136 remains pulled, preferably, however, the pulse is single shot and of a limited duration. By way of example, the pulse duration is approximately 100 milliseconds in duration, though this may be varied according to the sensitivity of the destination/target that is configured to sense the pulse. Once the pulse is generated, continued actuation of the switch 202 is not effective to actuate the light emitter 200. The capacity to pulse to light emitter 200 may be reset after a predetermined delay, after a release of the trigger 136 from the switch 202 is detected, or some combination of the two. The aforementioned printed circuit board 204 may include various circuit components that implements such single-shot, set duration pulsing functionality to be generated from the light emitter 200. The pulse duration may be adjustable by the user, or set at the time of manufacture. The specifics of the pulsing of the light emitter 200 is presented by way of example only and not of limitation, and any other suitable light emission technique may be readily substituted without departing from the scope of the present disclosure.

Figure 7C:
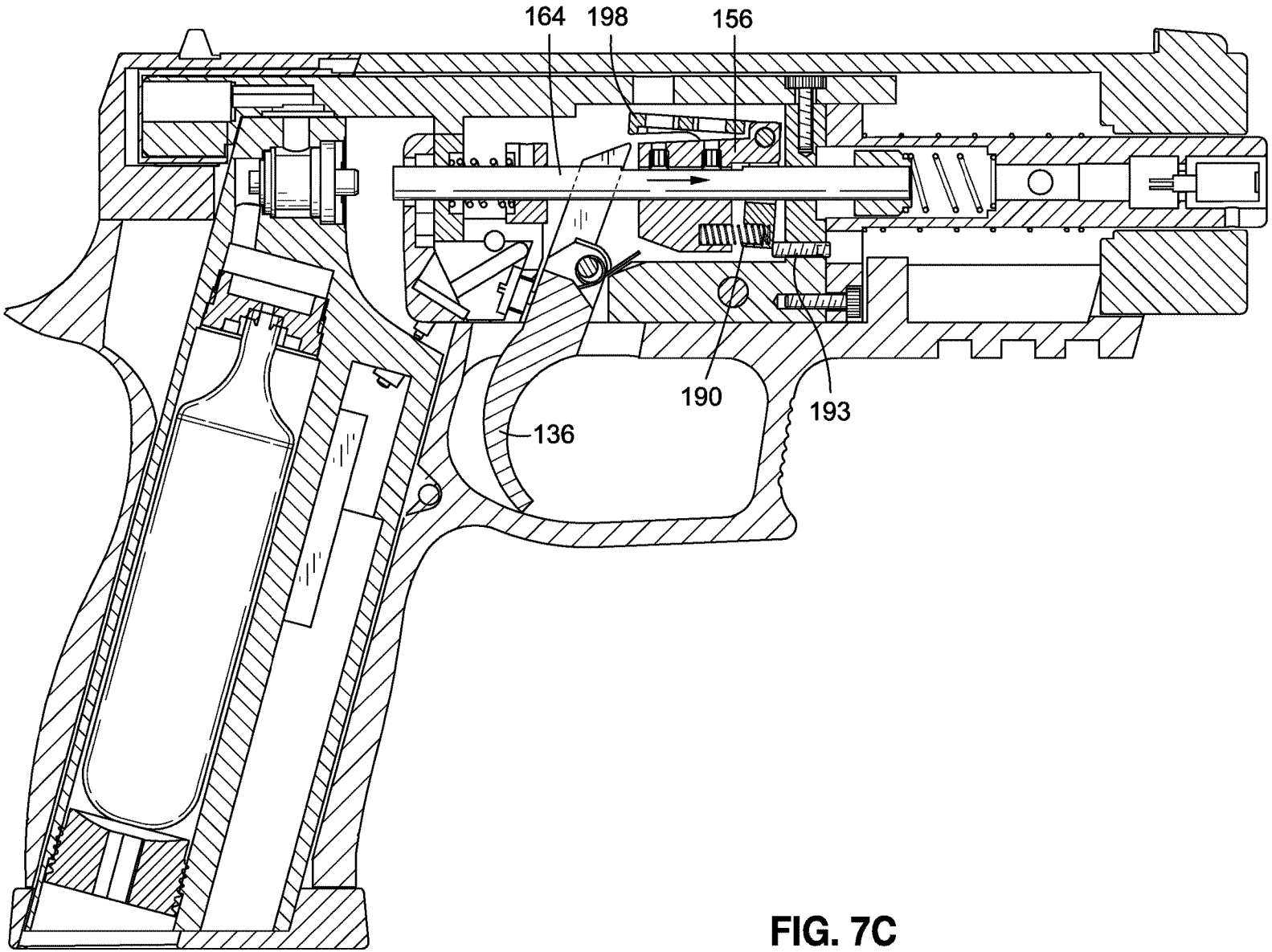
Figure 7D:
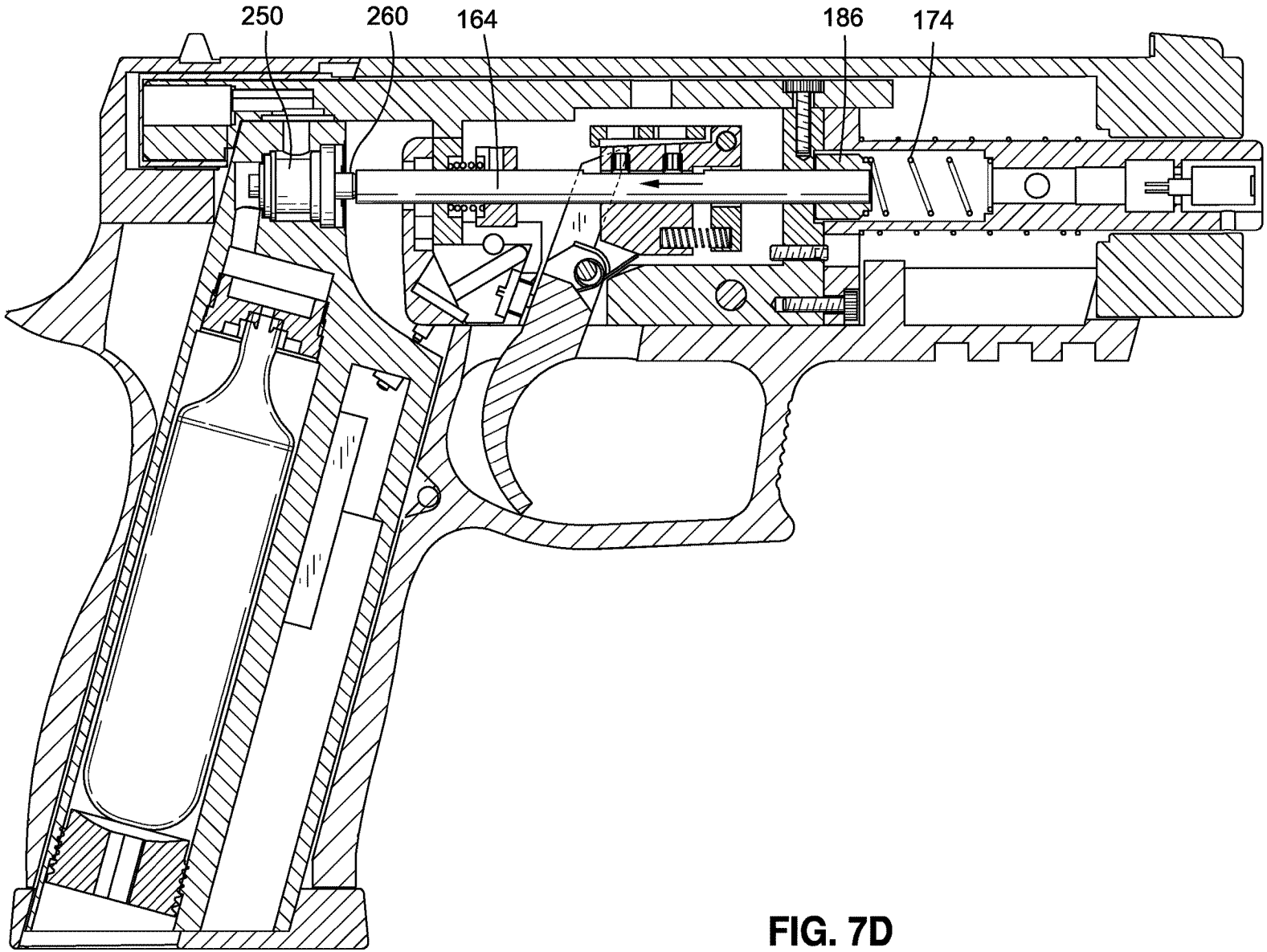

Referring to FIG. 7C, the sear block 156 continues to move forward under the force of the trigger 136, but eventually impacts the sear trip set screw 193. When this occurs, the sear 148 pivots rearward from the sear block 156, overcoming the bias from the sear return spring 190. This also effectively disengages the sear block 156 and the firing pin 164 from the trigger hook, and rearward motion thereof is no longer restricted. As shown in FIG. 7D, the rearward bias upon the firing pin 164 as exerted thereon through the firing pin spring compressor collar 186 by the firing pin spring 174 drives the firing pin 164 rearward against the actuator 260 of the gas valve 250.

Figure 8A:
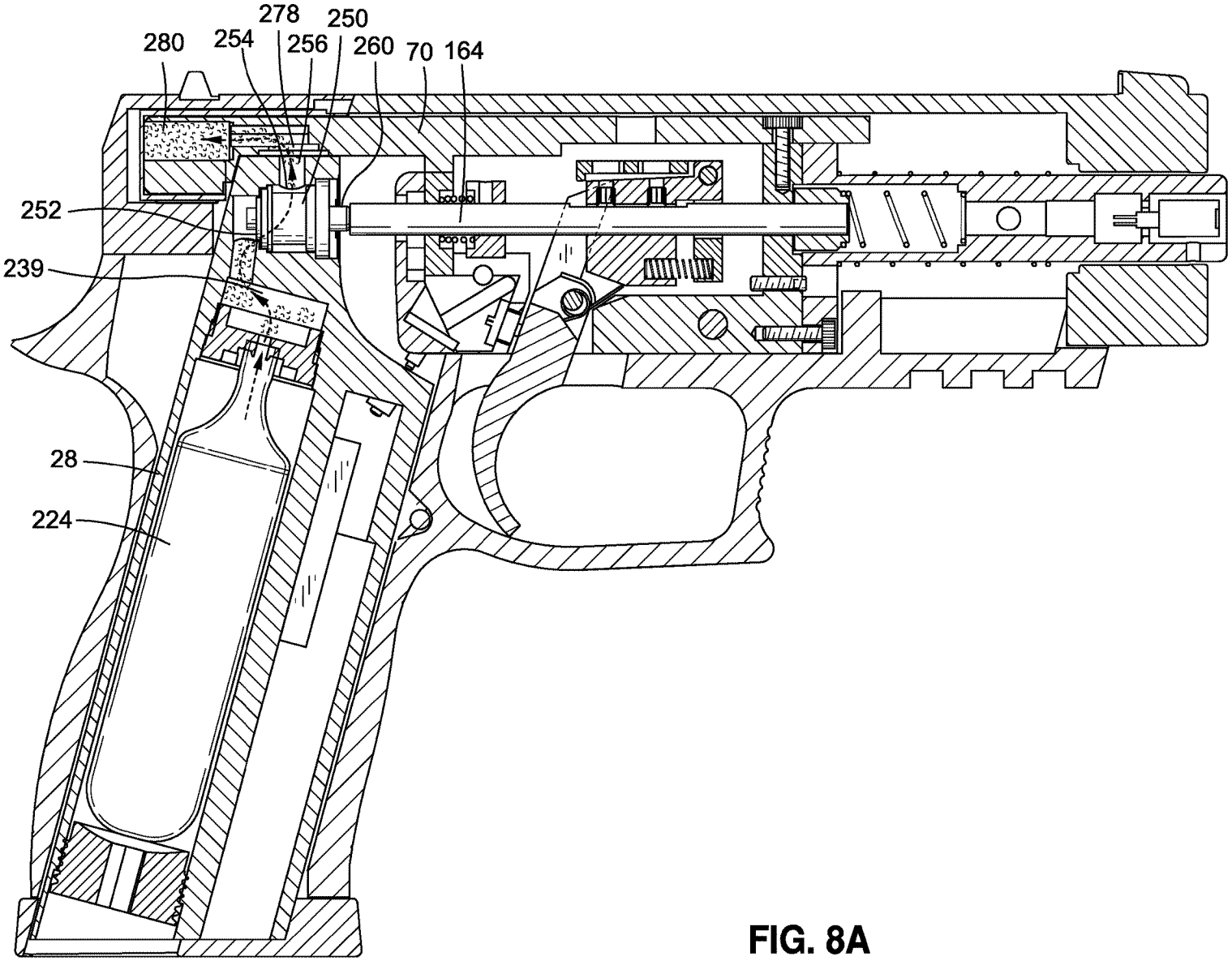
FIGS. 8A-8B are side cross sectional views of the weapon training device showing the cycling of the slide in response to a discharge of compressed gas to the piston.
Figure 8B:
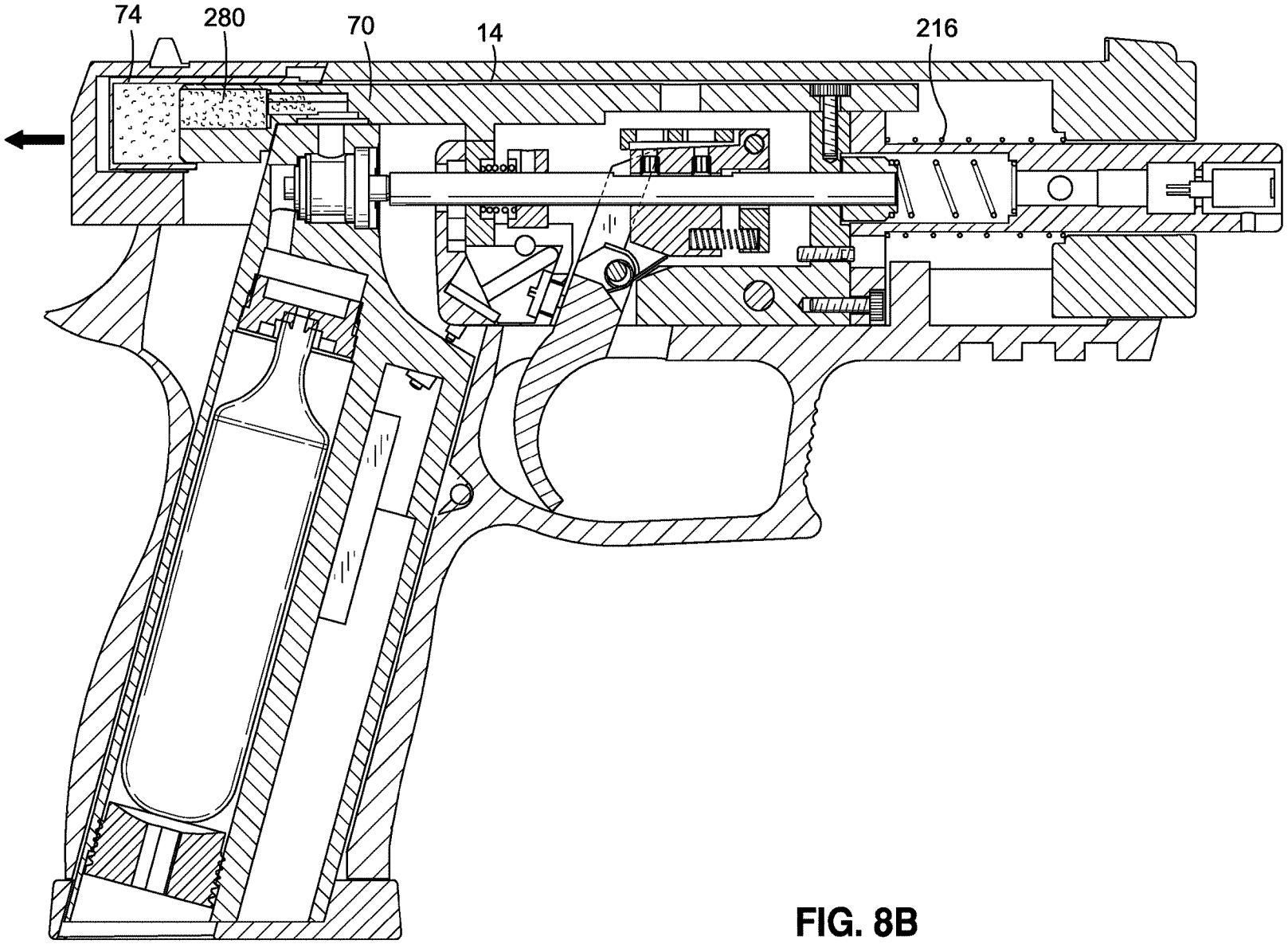

With reference to FIGS. 8A and 8B, once the firing pin 164 strikes the actuator 260 of the gas valve 250, the compressed gas in the compressed gas chamber 239 and in the gas cylinder 224 is directed through the gas valve 250 from the inlet port 252, through the body of the gas valve 250, and out of the outlet port 254. The volume and/or duration of the gas that is permitted to pass through the gas valve 250 is predetermined, and as indicated above, based at least partially upon the relative spring weights of the spring in the gas valve 250, the firing pin spring 174, and the counter spring 196. Additionally, the total mass of the components impacting the actuator 260, e.g., the firing pin 164, the sear 148, the sear block 156, the firing pin spring compressor collar 186, and the counter spring compressor 198, may also effect duration. Major adjustments, however, are understood to be based upon changing the spring weight of the counter spring 196, which increases the speed at which the forward motion of the firing pin 164 returns to a position where it no longer actuates the gas valve 250.

The dwell time of the firing pin 164 remaining in a position to trigger the actuator 260 such that compressed gas continues to flow to the gas cylinder 224 may also depend on the extent of compression of the firing pin spring 174 just prior to the release of the firing pin 164 from the sear 148. The aforementioned sear trip set screw 193 is understood to define the extent of forward travel of the firing pin 164/sear block 156 assembly (and hence compression of the firing pin spring 174) prior to its disengagement from the sear 148. A lower compression force upon the firing pin 164 is understood to decrease the dwell time thereof against the actuator 260, while a higher compression force is understood to increase the dwell time of the firing pin 164 against the actuator 260. As will be appreciated, an increase in dwell time increases the volume of gas flowing to the piston chamber 280, while a decrease in dwell time decreases the volume of gas flowing to the piston chamber 280. It is expressly contemplated that the sear trip set screw 193 is user adjustable, though it may be permanently set at the time of manufacture if desired.

The pressurized gas exits the cylinder opening 256 of the magazine 28, and into the passageway 278 to the piston chamber 280. The gas expands in the piston chamber 280 and exerts a pressure against the piston sleeve 72 as particularly illustrated in FIG. 8B. This expansion causes the piston sleeve 72 to move away from the piston 70. With the piston sleeve 72 fixed to the slide 14, this causes the slide 14 to move rearward. Upon reaching its longitudinal extension limit, the slide 14 is driven forward again by the aforementioned action spring 216. The excess compressed gas may be dispersed through the bottom of the slide 14.

The reciprocation of the slide 14 is understood to provide a greater level of realism to the weapon training device 10. The "blow back" and the simulated recoil may be comparable to some firearms, or at the very least, provide enough of a jarring sensation to the user where training for avoiding recoil anticipation becomes effective.

The particulars shown herein are by way of example and for purposes of illustrative discussion of the embodiments of the present disclosure only and are presented in the cause of providing what is believed to be the most useful and readily understood description of the principles and conceptual aspects. In this regard, no attempt is made to show details of the present invention with more particularity than is necessary, the description taken with the drawings making apparent to those skilled in the art how the several forms of the present invention may be embodied in practice.

What is claimed is:

1. A magazine for weapon training device, comprising:

a magazine body defined by a front and an opposed rear, and including a first compartment and a second compartment;

a gas cylinder with a cylinder outlet, the gas cylinder being disposed within the first compartment;

a gas valve mounted to the magazine body and having an inlet port in fluid communication with the gas cylinder, an outlet port, a valve member, and a front-facing actuator connected to the valve member and actuatable by a rearward travel of a firing pin and;

a battery disposed within the second compartment; and one or more terminals in electrical communication with the battery mounted to the magazine body.

2. The magazine of claim 1, wherein the magazine body is defined by a bottom end opening to the first compartment.

3. The magazine of claim 2, further comprising:

a base plate removably attachable to the bottom end of the magazine body.

4. The magazine of claim 1, further comprising:

a cylinder adapter mounted within the magazine body and including a connector engaging with the cylinder outlet of the gas cylinder, the connector being in fluid communication with the inlet port of the gas valve.

5. The magazine of claim 1, wherein the magazine body is defined by a top end with an opening in fluid communication with the outlet port of the gas valve.

6. The magazine of claim 1, wherein the outlet port is directly engageable in fluid communication with a chamber opening of a moving piston.

7. The magazine of claim 1, wherein the actuator of the gas valve is exposed on and protrudes from the front of the magazine body.

8. The magazine of claim 1, wherein the one or more terminals are exposed on the front of the magazine body.

9. The magazine of claim 1, wherein a first opening axis of the inlet port of the gas valve is offset from a second opening axis of the outlet port.

10. The magazine of claim 9, wherein the first opening axis is perpendicular to the second opening axis.

11. The magazine of claim 9, wherein an actuation axis of the valve member is aligned with the first opening axis of the inlet port.

* * * * *